US005903658A

United States Patent [19]

Okazaki et al.

[11] Patent Number: 5,903,658

[45] Date of Patent: May 11, 1999

[54] LOUDSPEAKER AND A METHOD FOR PRODUCING THE SAME

[75] Inventors: Masatoshi Okazaki, Ashiya; Shinya Mizone, Tsu; Toshihiro Shimizu, Matsusaka, all of Japan

[73] Assignee: Matsushita Electric Industrial Co., Ltd., Kadoma, Japan

[21] Appl. No.: 09/013,703

[22] Filed: Jan. 26, 1998

Related U.S. Application Data

[62] Division of application No. 08/413,096, Mar. 29, 1995.

[30] Foreign Application Priority Data

Mar. 31, 1994 [JP] Japan ..... 6-62669
Apr. 14, 1994 [JP] Japan ..... 6-75829

[51] Int. Cl.[6] ..... H04R 25/00

[52] U.S. Cl. ..... 381/428; 381/426; 181/169

[58] Field of Search ..... 381/423, 426, 381/427, 428, 432; 181/149, 167, 169, 170; 428/284; 264/320

[56] References Cited

U.S. PATENT DOCUMENTS 4,582,163 4/1986 Catthoor .
5,283,027 2/1994 Sakamoto et al. .
5,458,958 10/1995 Kanzaki et al. .

FOREIGN PATENT DOCUMENTS 57-40718 8/1982 Japan .

*Primary Examiner*—Huyen Le
*Attorney, Agent, or Firm*—Renner, Otto, Boisselle & Sklar, P.L.L.

[57] ABSTRACT

Water-proofed natural pulp or organic synthetic fibers are with polyester-type fibers having a low melting point, and subjected to a paper fabrication process. The fabricated product is dried with hot air at a temperature higher than the melting point of the polyester-type fibers, thereby melt-bonding only intersections of the fibers without completely fusing the polyester-type fibers. The pressure of the hot air contributes to the formation of a predetermined shape. Thus, a water-proof diaphragm for a loudspeaker, having a large thickness, a low density, a high internal loss and a high stiffness, is obtained. By incorporating the thus formed diaphragm, a high-performance loudspeaker having a low distortion and a broad reproducing range is obtained.

10 Claims, 12 Drawing Sheets

LOUDSPEAKER AND A METHOD FOR PRODUCING THE SAME

This is a division of copending application Ser. No. 08/413,096, filed Mar. 29, 1995.

BACKGROUND OF THE INVENTION

1. Field of the Invention

The present invention relates to a loud speaker to be used for various acoustic apparatuses, and a method for producing the same.

2. Description of the Related Art

FIG. 1 is a half cross-sectional view showing a configuration for a typical loud speaker 20. FIG. 2 is an exploded perspective view showing details of the loud speaker 20. The same constituent elements are indicated by the same reference numerals in FIGS. 1 and 2.

As shown in FIGS. 1 and 2, the loud speaker 20 includes a lower plate 3 integral with a center pole 2, a magnet ring 4 provided on a bottom portion of the lower plate 3 so as to surround the center pole 2, and an upper plate 5 provided on an upper face of the magnet ring 4. The lower plate 3, the magnet ring 4, and the upper plate 5 are coupled to one another to constitute a magnet circuit 1.

On an upper face of the upper plate 5, an inner periphery of the frame 6 is coupled. A gasket 7 and an outer periphery of a diaphragm 8 are attached to an outer periphery of the frame 6 using an adhesive. A voice coil 9 is coupled to an inner periphery of the diaphragm 8.

A middle portion of the voice coil 9 is supported by an inner periphery of the damper 10, an outer periphery of the damper 10 being supported by the frame 6. A lower portion of the voice coil 9 is inserted into a magnetic gap 11 formed between the center pole 2 of the lower frame 3 and the upper frame 5 (which are included in the magnetic circuit 1) without being eccentric. Moreover, a dust cap 12 for preventing dust from entering the magnetic circuit 1 is provided on the upper side of a central portion of the diaphragm 8.

It is preferable that the material constituting the diaphragm 8 has such properties as high elasticity, low density, and high internal loss for the following reasons.

The high-frequency range resonance frequency of the diaphragm 8 increases as a specific elasticity $E/\rho$(where E represents the elasticity modulus and $\rho$ represents the density) of the material constituting the diaphragm 8 increases, that is, as the elasticity modulus E increases and as the density $\rho$ decrease. Such a loud speaker is capable of reproducing sounds in a higher frequency range and therefore realizing a broader reproduction range.

Moreover, the diaphragm 8 achieves a flatter frequency characteristic curve and a lower distortion rate as the internal loss of its material increases.

In view of the above, a principal material used for the diaphragm 8 of the conventional loud speaker 20 is paper which is composed mainly of natural pulp such as wood pulp. This is because paper has an appropriate elasticity modulus and internal loss as well as low density, and therefore provides advantages that a diaphragm composed of a synthetic resin or a complex thereof cannot attain.

On the other hand, the voice coil 9 is required to withstand a large input signal applied thereto. In order for a loud speaker to have good resistance for such a large input, the voice coil 9 is required to have an increased inflammability and heat resistance for the following reasons.

When an input signal is applied to the voice coil 9, an electric current flows in a coil (not shown in FIG. 1 or 2) of the voice coil 9 so as to generate Joule's heat. The Joule's heat increases as the level of the input signal increases, thereby drastically raising the temperature of the voice coil 9. As a result, a bobbin (not shown in FIG. 1 or 2) around which the coil is wound may be burnt, or varnish which is used to couple the coil to the bobbin may deteriorate through softening, causing the coil to fall off the bobbin.

FIG. 3 shows an exemplary configuration for a conventional voice coil 9 designed so as to overcome the above-mentioned problem. The voice coil 9 includes a bobbin 13 composed of a strip of a metal foil, e.g., aluminum, bent into a cylindrical shape. Kraft paper 14 is wound, for reinforcement and insulation, around an outer periphery of the voice coil 9 where a coil 15 is not wound. The bobbin 13 is obtained by winding the voice coil 9 on a portion of the bobbin 13 where the kraft paper 14 is not wound. In this configuration, the coil 15 is directly wound on the metal foil constituting the bobbin 13, so that the metal foil functions to radiate the heat generated in the coil 15, thereby preventing elevation of temperature.

Recently, there has been a trend for using metals such as aluminum or organic foams for the material of the diaphragm 8, instead of the above-mentioned paper. However, organic foams have low elasticity and cannot attain sufficient characteristics. On the other hand, a metal diaphragm has only a small internal loss and the weight thereof is large. Therefore, these substitute materials for paper are not optimum materials for diaphragms of loud speakers for use in acoustic apparatuses.

There have been developed diaphragms for loud speakers made of materials consisting of inorganic fibers and/or organic synthetic fibers mixed with paper so as to improve the elasticity of the paper. However, the expected effect of improving the elasticity has not been attained.

Furthermore, paper diaphragms tend to absorb, and therefore are generally susceptible to, moisture. For example, paper diaphragms are not appropriate for such applications as loud speakers to be attached on the doors of automobiles, which require a particularly good water-proofness. In order to solve this problem, diaphragms for loud speakers requiring a high degree of water-proofness have typically been produced by adhering water repellent on pulp fibers during fabrication, or impregnating the fabricated paper diaphragm with a synthetic resin solution so as to provide the paper with water-proof properties.

Very recently, however, the loud speakers to be attached on the doors of automobiles have particularly been required to be sufficiently resistant against surfactants included in detergents for washing automobiles, e.g., car shampoos. The above-mentioned method of adhering water repellent on pulp fibers or impregnating the fabricated paper diaphragm with a synthetic resin solution cannot attain sufficient resistance against such surfactants.

One solution to this problem has been proposed, according to which a water-proof synthetic resin film is laminated onto a surface of a paper diaphragm after the fabrication thereof. However, this creates a new problem of the need for specific jigs and equipment for attaching the synthetic resin film onto the paper diaphragm.

In order to overcome the above-mentioned problems, Japanese Patent Publication No. 57-40718 describes a diaphragm produced by using a material including a principal material of short fibers, such as polyethylene, polypropylene, nylon, and polyacrylonitrile, or synthetic pulp obtained by fibrillating these fibers, and a subordinate material of fibers such as inorganic fibers, organic synthetic fibers, or natural fibers mixed in the principal material, subjecting the material to a paper-fabrication process, and melting the resultant complex synthetic pulp so as to mold it into a desired shape. This diaphragm has excellent environmental characteristics such as water-proofness. However, the diaphragm also has the three following problems.

First, it is difficult to reduce the density of the obtained diaphragm because high-density inorganic fibers, e.g., carbon fibers, alumina fibers, and glass fibers, are mixed into the principal material in order to improve the elasticity of the molded product.

Second, the synthetic pulp used for the above-mentioned diaphragm has relatively short fiber lengths and therefore has low freeness. As a result, the fabrication process takes a long time.

Third, the synthetic pulp used for the above-mentioned diaphragm has a relatively high beating degree, and has relatively short fiber lengths, so that it is difficult to obtain a bulky product after a percolation process. Moreover, since the synthetic pulp is melted during the drying-molding process, the obtained molded product has a film-like shape, so that it is difficult to increase the thickness of the molded product and to adequately reduce the density and increase the internal loss thereof.

On the other hand, in the conventional voice coil 9 shown in FIG. 3, the metal foil used for the bobbin 13, which is incorporated with a view to improving the heat resistance of the voice coil 9, has a large weight, thereby deteriorating the performance of the loud speaker. Moreover, since metals are good electrical conductors, the use of a metal foil for the bobbin 13 may cause a short-circuiting of the coil 15.

Alternatively, a sheet composed of heat-resistant chemical fibers, such as paper composed of aromatic polyamide fibers, e.g., aramid paper or NOMEX paper (manufactured by Du Pont Ltd.) is occasionally used for the bobbin 13 of the voice coil 9. However, such paper slightly absorbs moisture. As a result, when the temperature of the voice coil 9 rapidly increases, the moisture absorbed in the paper is gasified so that swelling may occur in a portion of the bobbin 13 where the coil 15 is wound. Furthermore, it is difficult for the bobbin 13 as described above to be completely severed. Thus, a portion of one or more of the aromatic polyamide fibers may be left at the severed surface. These fibers may also remain in a plumous state on the surface of the sheet. In either case, such portions of the aromatic polyamide fibers can cause extraordinary noises during the operation of the loud speaker, thus deteriorating the quality of the loud speaker.

Furthermore, as described above in connection with the diaphragm 8, loud speakers to be attached on the doors of automobiles are required to be particularly water-proof, so that the voice coil 9 is also required to have an improved water-proofness as well as the diaphragm 8.

SUMMARY OF THE INVENTION

A loudspeaker of the invention includes: a magnetic circuit portion including a magnetic gap; a frame coupled to an upper face of the magnetic circuit portion; a diaphragm, an outer periphery thereof being attached to an outer periphery of the frame; and a voice coil coupled to an inner periphery of the diaphragm, the voice coil being inserted into the magnetic gap, wherein the diaphragm is formed by mixing water-proofed natural pulp or organic synthetic fibers as a principal material with polyester-type fibers having a low melting point as a subordinate material, only intersections among the fibers being melt-bonded.

A method for producing a loudspeaker of the invention includes: a beating step for obtaining a principal material of natural pulp or organic synthetic fibers; a mixing step for mixing the principal material with polyester-type fibers having a low melting point, and further with a water repellent to be affixed thereto; a paper fabrication step for subjecting a slurry obtained in the mixing step to a paper fabrication process; a forming step for drying the fabricated slurry by being heated with hot air at a predetermined temperature higher than the melting point of the polyester-type fibers, and forming the fabricated slurry into a predetermined shape; a trimming step for conducting a trimming process so as to obtain the diaphragm; and a fabricating step for forming a loudspeaker using the obtained diaphragm.

In one embodiment, the melting point of the polyester-type fibers is in the range from about 120 to about 180° C.

In another embodiment, a thickness of the polyester-type fibers is in the range of about 0.5 to about 5 deniers.

In still another embodiment, a fiber length of the polyester-type fibers is in the range of about 1 to about 15 mm.

In still another embodiment, the polyester-type fibers are mixed in an amount of about 1 to about 50% by weight based on the principal material.

According to another aspect of the invention, a loudspeaker includes: a magnetic circuit portion including a magnetic gap; a frame coupled to an upper face of the magnetic circuit portion; a diaphragm, an outer periphery thereof being attached to an outer periphery of the frame; and a voice coil coupled to an inner periphery of the diaphragm, the voice coil being inserted into the magnetic gap, wherein the diaphragm is formed of a molded product obtained by dry-molding a slurry of a principal material of water-repellentized natural pulp mixed with water-proof synthetic pulp having a minute film-like shape, a water-repellent synthetic resin film being disposed on a surface of the molded product.

A method for producing a loudspeaker of the invention includes: a beating step for obtaining a principal material of natural pulp or organic synthetic fibers; a mixing step for mixing the principal material with water-proof synthetic pulp having a minute film-like shape, and further with a water repellent to be affixed thereto; a paper fabrication step for subjecting a slurry obtained in the mixing step to a paper fabrication process; a forming step for drying the fabricated slurry by being heated, thereby obtaining a molded product having a predetermined shape; an immersion step for impregnating the molded product with an organic resin solution mixed with a water repellent, and drying, thereby forming a water-repellent synthetic resin film on a surface of the molded product; a trimming step for conducting a trimming process so as to obtain the diaphragm; and a fabricating step for forming a loudspeaker using the obtained diaphragm.

In one embodiment, the synthetic pulp is formed of a meta-type aramid resin.

In another embodiment, the diaphragm is further mixed with water-proof fibers. The water-proof fibers are mixed into the principal material in the mixing step. Preferably, the water-proof fibers are polyester-type fibers.

According to still another aspect of the invention, a loudspeaker includes: a magnetic circuit portion including a magnetic gap; a frame coupled to an upper face of the magnetic circuit portion; a diaphragm, an outer periphery thereof being attached to an outer periphery of the frame; and a voice coil coupled to an inner periphery of the diaphragm, the voice coil being inserted into the magnetic gap, wherein the voice coil further includes: a cylindrical bobbin formed of a sheet obtained by mixing water-proof heat-resistant synthetic pulp having a minute film-like shape with inorganic fillers and water-proof heat-resistant synthetic fibers and then subjecting to a paper fabrication process and to a pressure-heating process using a calender; and a coil wound on an outer surface of at least a portion of the bobbin.

A method for producing a loudspeaker of the invention includes the steps of: mixing water-proof heat-resistant synthetic pulp having a minute film-like shape with inorganic filler and water-proof heat-resistant synthetic fibers; subjecting the mixed synthetic pulp to a paper fabrication process; forming a sheet by subjecting the fabricated synthetic pulp to a pressure heating process using a calender; forming a cylindrical bobbin using the sheet; forming a voice coil using the bobbin; and fabricating a loudspeaker using the obtained voice coil.

In one embodiment, the synthetic pulp is formed of a meta-type aromatic polyamide.

In another embodiment, the synthetic fibers are short fibers formed of a para-type aromatic polyamide.

In still another embodiment, a thickness of the sheet after being processed by the calender is in the range from about 30 to about 500 $\mu$m.

In still another embodiment, a bulk density of the sheet after being processed by the calender is in the range from about 0.6 to about 1.5 g/cm$^3$.

Thus, the invention described herein makes possible the advantages of (1) providing a loud speaker including a diaphragm having a high elasticity modulus and excellent water-proofness and/or a light-weight voice coil having excellent inflammability, water-proofness, and adhesion, the loud speaker therefore being capable of withstanding a large input; and (2) a method for producing the same.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of examples, with reference to the accompanying figures.

Example 1

Figure 4:
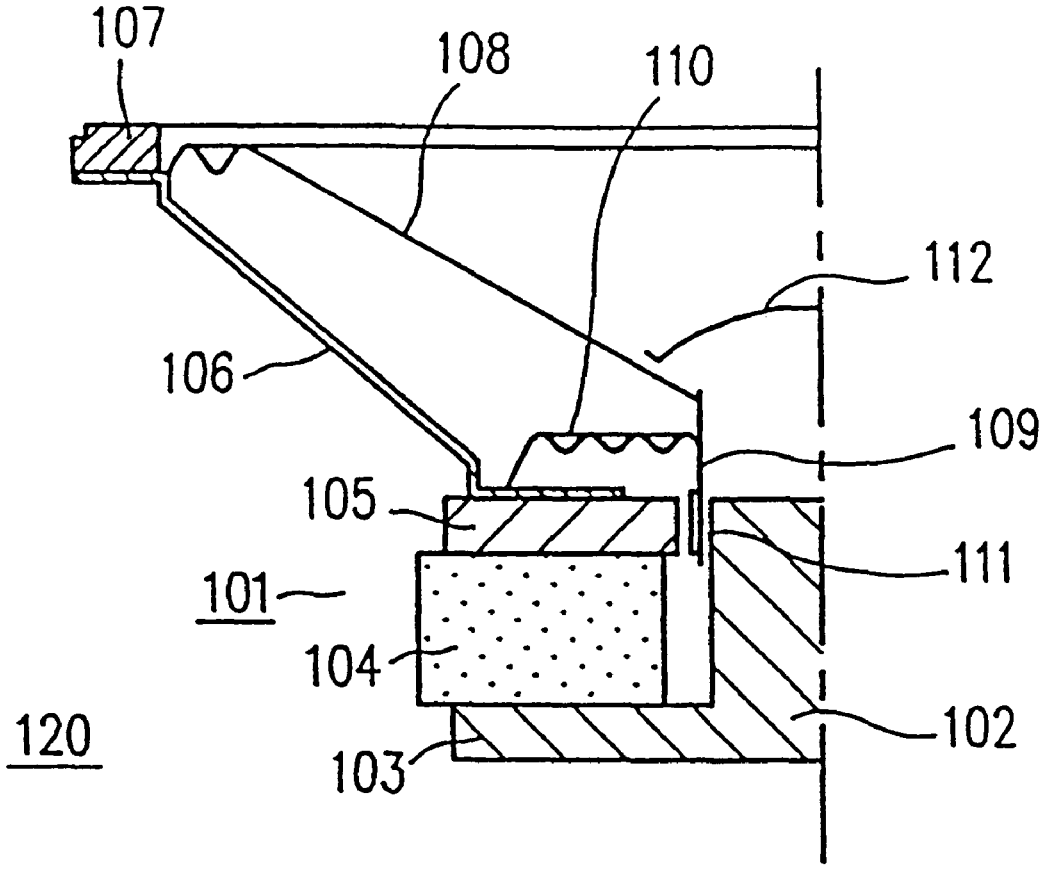
FIG. 4 is a half cross-sectional view showing a configuration for a loud speaker according to a first example of the present invention.

FIG. 4 is a half cross-sectional view showing a configuration for a loud speaker 120 produced according to a first example of the present invention.

As shown in FIG. 4, the loud speaker 120 includes a lower plate 103 integral with a center pole 102, a magnet ring 104 provided on a bottom portion of the lower plate 103 so as to surround the center pole 102, and an upper plate 105 provided on an upper face of the magnet ring 104. The lower plate 103, the magnet ring 104, and the upper plate 105 are coupled to one another to constitute a magnet circuit 101.

On an upper face of the upper plate 105, an inner periphery of the frame 106 is coupled. A gasket 107 and an outer periphery of a diaphragm 108 are attached to an outer periphery of the frame 106 by using an adhesive. A voice coil 109 is coupled to an inner periphery of the diaphragm 108.

A middle portion of the voice coil 109 is supported by an inner periphery of the damper 110, an outer periphery of the damper 110 being supported by the frame 106. A lower portion of the voice coil 109 is inserted into a magnetic gap 111 formed between the center pole 102 of the lower frame 103 and the upper frame 105 (which are included in the magnetic circuit 101) without being eccentric. Moreover, a dust cap 112 for preventing dust from entering the magnetic circuit 101 is provided on the upper side of a central portion of the diaphragm 108.

Figure 5:
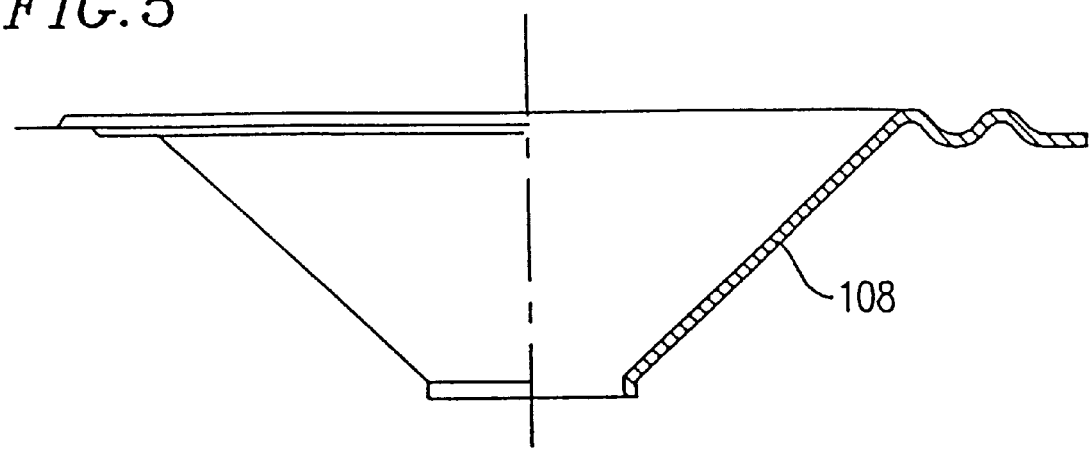
FIG. 5 is a half cross-sectional view showing a configuration for a diaphragm of the loud speaker shown in FIG. 4.
Figure 6:
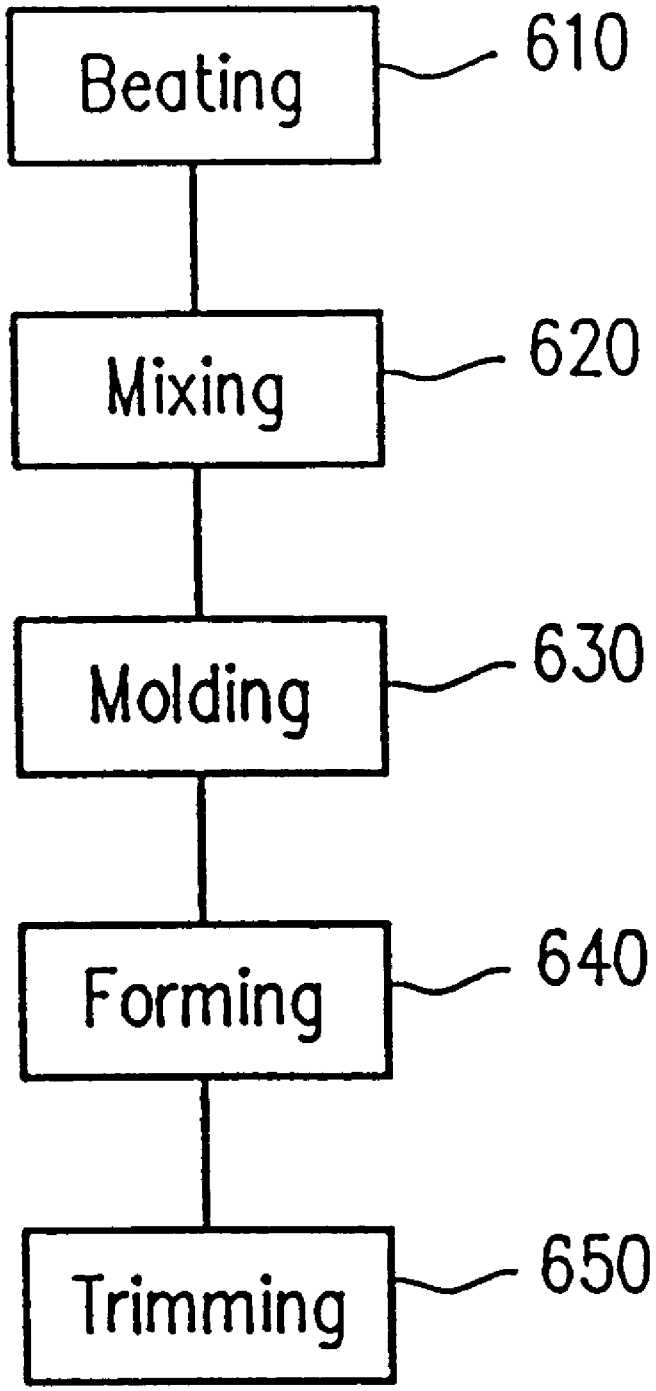
FIG. 6 is a flow chart showing the production process for the diaphragm shown in FIG. 5.

FIG. 5 is a half cross-sectional view showing the diaphragm 108. Hereinafter, a method for producing the diaphragm 108 will be described with reference to a flow chart shown in FIG. 6.

First, in a beating step 610, un-bleached kraft pulp (hereinafter referred to as "UKP") having a freeness (Canadian Freeness: as measured by the Canadian standard freeness measuring apparatus) of 550 cc is beaten so as to give a slurry of UKP. The UKP functions as a principal material.

Next, in a mixing step 620, predetermined additives such as a reinforcement material, a dye, and a binder are mixed with the UKP slurry thus obtained. Specifically, in the present example, modified polyester fibers (melting point: about 120° C. to about 180° C.; fiber length: about 1 to about 15 mm; thickness: about 0.5 to about 5 deniers) are added in an amount of about 1% to about 50% by weight based on the absolute dry weight of the UKP. Typically, modified polyester fibers having a melting point of 130° C., a fiber length of 5 mm, and a thickness of 2 deniers are added in an amount of 10% by weight based on the absolute dry weight of the UKP. Furthermore, a fluorine-type water repellent is added in an amount of about 0.05% to about 0.5%, e.g., 0.1%, by weight based on the absolute dry weight of the UKP so as to obtain a mixture to be subjected to a paper-fabrication process. The modified polyester fibers function as a subordinate material. As the fluorine-type water repellent, a product designated as "DICGUARD F-400" (manufactured by Dainippon Ink and Chemicals, Inc.) can be used, for example.

Furthermore, in a molding step 630, that is, in a paper-fabrication step, the above-mentioned mixture (slurry) is subjected to a paper-fabrication process by using a screen formed into a desired shape of the diaphragm 108, e.g., a conical shape, and is dehydrated.

Then, in a forming step 640, the fabricated product is dried by being heated with pressurized hot air at a temperature higher than the melting point of the polyester-type fibers, e.g., 220° C., for about 40 seconds. Thus, only intersections of the fibers are fuse-bonded without completely fusing the polyester-type fibers. The pressure of the hot air contributes to the formation of a predetermined shape.

Finally, the molded diaphragm is subjected to a trimming process in a trimming step 650 so as to have predetermined inner and outer shapes. Thus, the diaphragm 108 having a predetermined shape, for example, a conical shape with a diameter of 120 mm and a weight of 2.2 g is obtained.

The diaphragm 108 obtained in the above-mentioned manner has a freeness of 670 cc, an elasticity modulus of $4\times10^9$ N/cm$^2$, an internal loss (tanδ) of 0.067, a thickness of 0.73 mm, and a density of 0.052 g/cm$^3$.

For comparison, a conventional paper diaphragm was produced by subjecting the above-mentioned UKP having a freeness of 550 cc to a paper-fabrication process and a heat-press molding by using a mold maintained at 180° C. with a pressure of 2 kg/cm$^2$ applied, the diaphragm having the same shape and diameter as the diaphragm 108 of the present example. Measurement of the characteristics of this conventional paper diaphragm revealed an elasticity modulus of $1.4\times10^9$ N/cm$^2$, an internal loss (tanδ) of 0.035, a thickness of 0.36 mm, and a density of 0.067 g/cm$^3$.

A diaphragm, as a constituent element of a loud speaker, is subjected to long-term use, and is preferably required to have a large strength (stiffness). In general, in order to improve the stiffness of a diaphragm, the molded diaphragm is required to be sufficiently thick. The diaphragm 108 produced according to the present example has a thickness of 0.73 mm, thereby achieving a thick diaphragm 108 with a large stiffness in spite of its small weight.

On the other hand, the above-mentioned conventional diaphragm has only a thickness of 0.36 mm, that is, it is difficult to increase the stiffness of the conventional diaphragm by increasing the thickness thereof. Although the stiffness of such a diaphragm may be increased by increasing the density thereof, there is an adverse effect in that the high-frequency range resonance frequency of a loud speaker incorporating the diaphragm lowers as the density of the diaphragm increases, thereby narrowing the range of frequencies reproducible by the loud speaker.

An observation of the surface and the interior of the diaphragm 108 obtained in the present example with a scanning electron microscope has revealed that the modified polyester fibers are present as if stitching through the UKP fibers. The UKP fibers and the modified polyester fibers are integrated with each other by being completely fused at the intersections thereof. Moreover, the intersections of the modified polyester fibers themselves are also fuse-bonded. As a result, the modified polyester fibers constitute a three-dimensional net-like structure present in the interspaces between the UKP fibers. The diaphragm 108 of the present example retains its shape owing to such interfusion between fibers.

Figure 1:
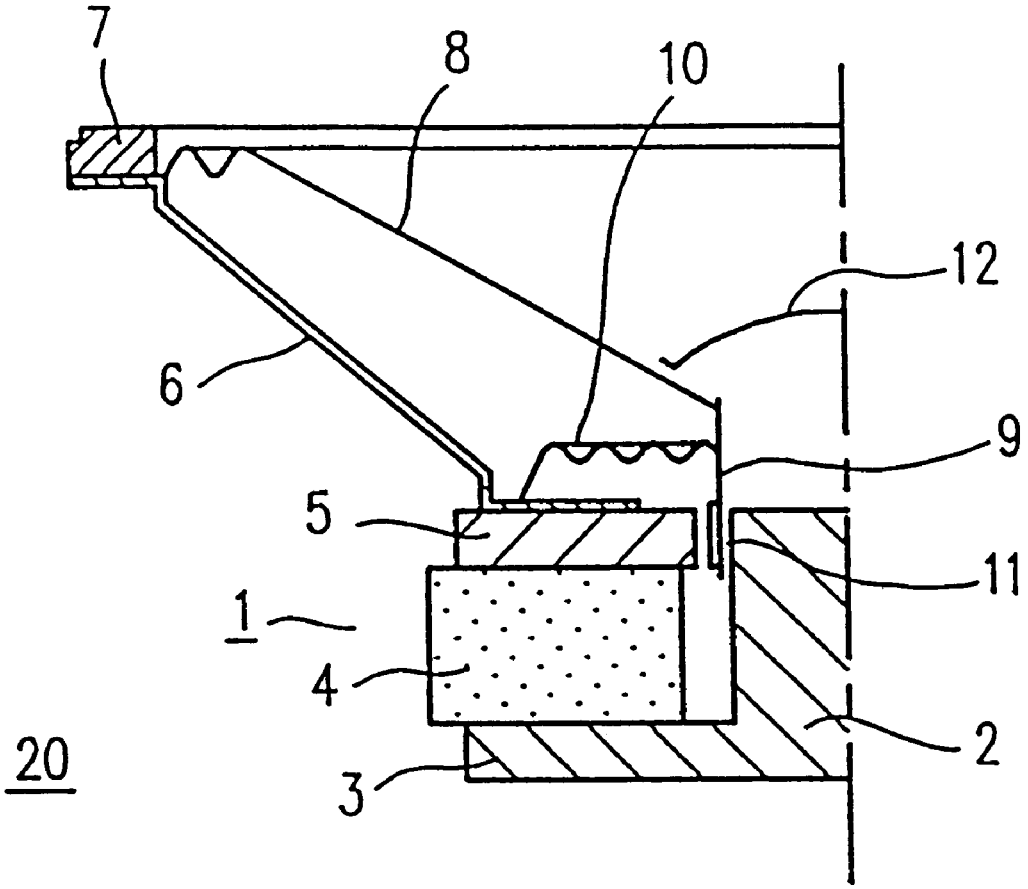
FIG. 1 PRIOR ART
FIG. 1 is a half cross-sectional view showing a configuration for a typical loud speaker.
Figure 2:
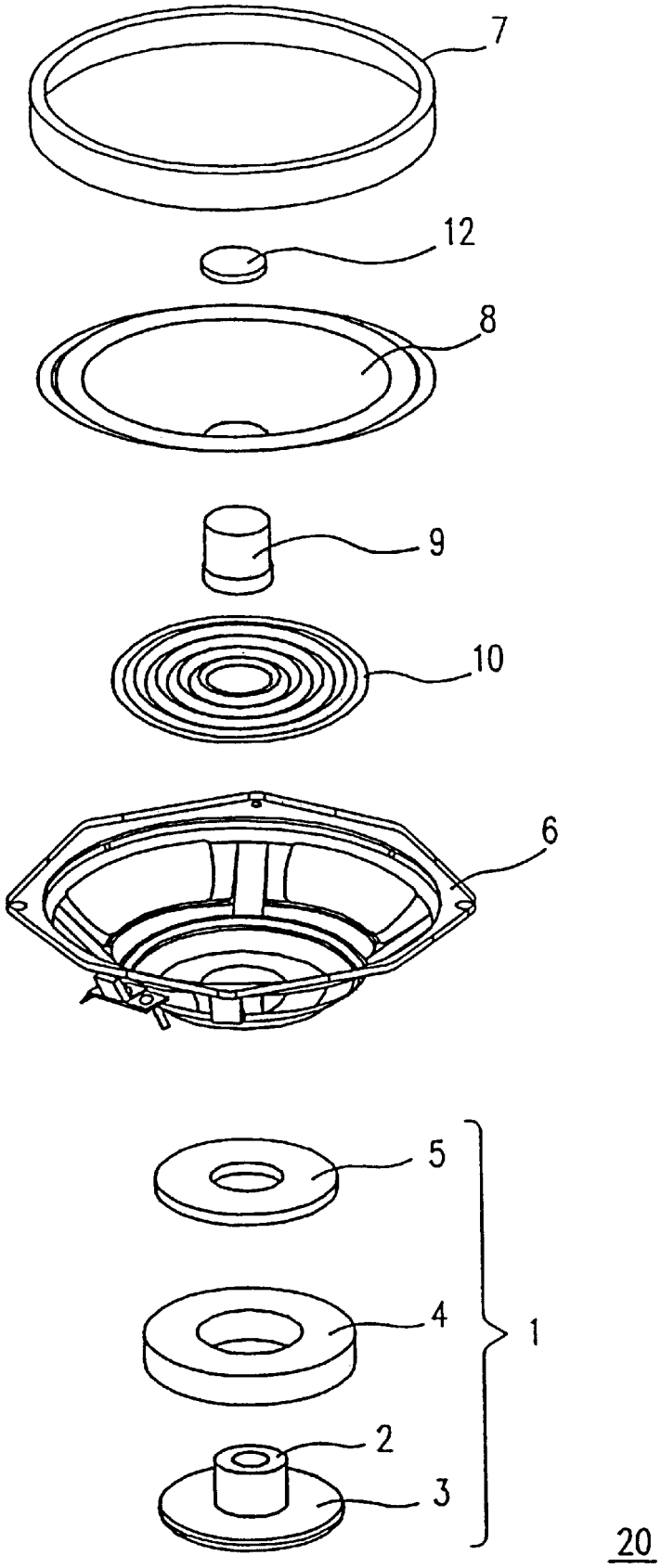
FIG. 2 PRIOR ART
FIG. 2 is an exploded perspective view showing details of the loud speaker shown in FIG. 1.
Figure 3:
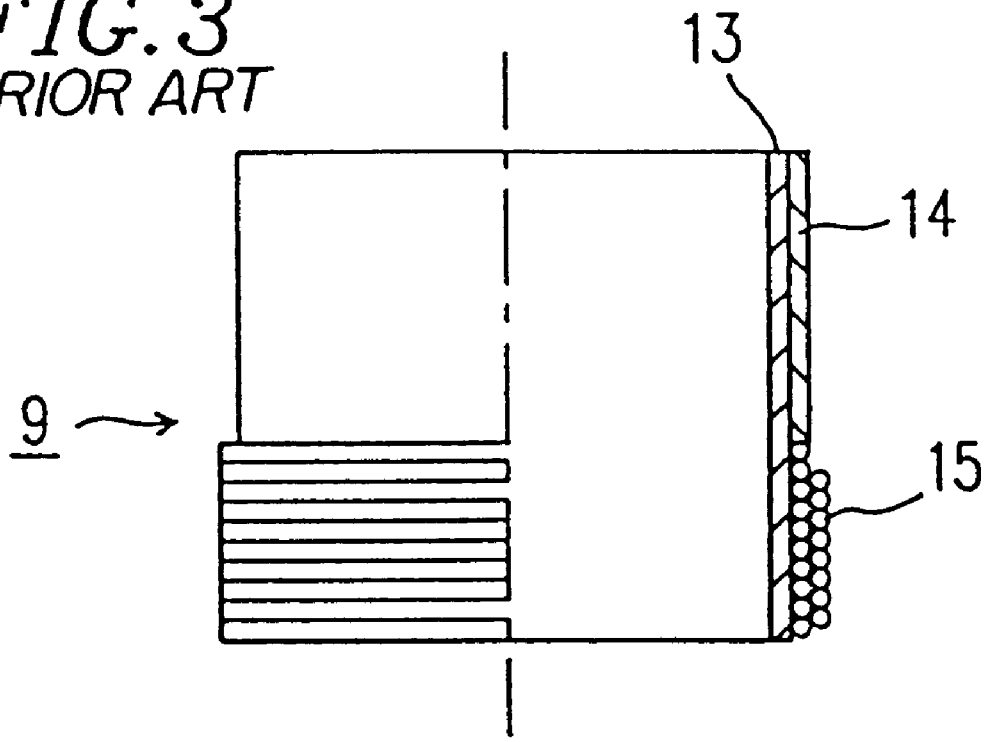
FIG. 3 PRIOR ART
FIG. 3 is a half cross-sectional view showing a configuration for a conventional voice coil.
Figure 7:
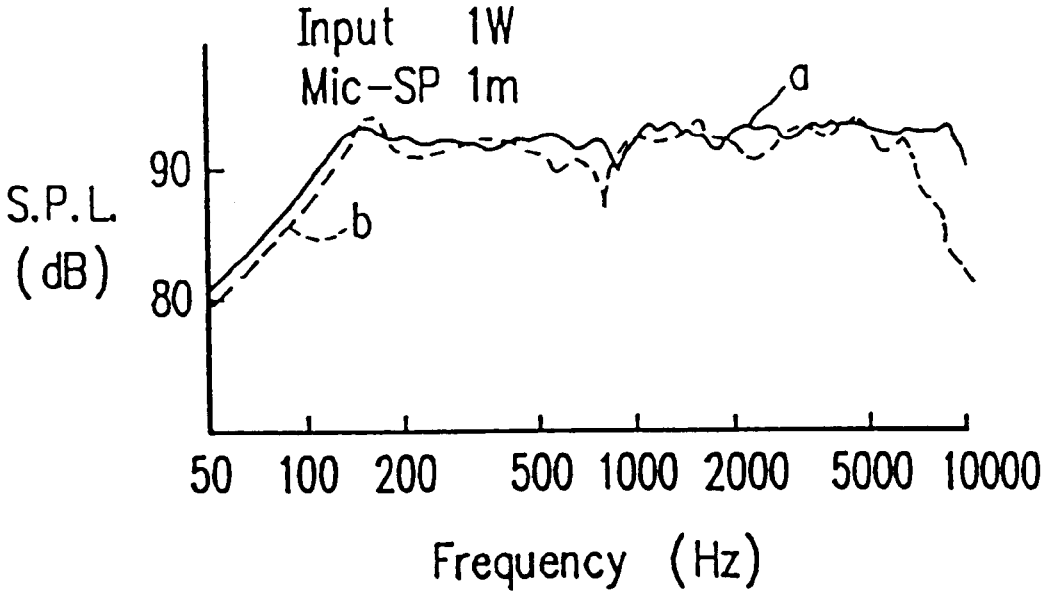
FIG. 7 is a graph showing the sound volume-frequency characteristics of the loud speaker according to the first example of the present invention and a conventional loud speaker.

FIG. 7 is a graph showing the sound pressure level (S.P.L.)-frequency characteristics (solid line a) of a loud speaker incorporating the diaphragm 108 of the present example and the S.P.L.-frequency characteristics (broken line b) of a loud speaker incorporating the conventional diaphragm 8 (shown in FIG. 1). The S.P.L. was measured with a microphone placed apart from the tested loudspeaker by 1 m. As seen from FIG. 7, the loud speaker incorporating the diaphragm 108 of the present example is capable of reproducing a broader range of frequencies than the loud speaker incorporating the conventional diaphragm 8.

Although UKP is used as the principal material in the above description, the principal material for the diaphragm is not limited thereto. For example, natural pulp such as wood, cotton, and linen, or organic synthetic fibers having a high elasticity modulus and a high melting point, e.g., an aromatic polyamide and highly crystalline vinylon. Regardless of the material to be used, the principal material is subjected to a water-proofing process by affixing a water repellent thereto.

The low-melting point polyester-type fibers used as the subordinate material preferably have a thickness of about 0.5 to about 5 deniers and a melting point of about 120° C. to about 180° C. This is because fibers having characteristics in the above-mentioned ranges do not completely fuse during the drying process and therefore are appropriate for the purpose of obtaining the above-mentioned structure where only the intersections are melt-bonded.

In order to ensure that the subordinate material of modified polyester fibers constitute a three-dimensional net-like structure in the interspaces between the UKP fibers while maintaining a high elasticity, it is preferable to prescribe the fiber length of the polyester-type fibers to be about 1 to about 15 mm, the polyester-type fibers being mixed in an amount of about 1% to about 50% by weight based on the principal material. The freeness of the diaphragm increases as the content ratio of the subordinate material increases.

As described above, the diaphragm of the present example is produced by mixing low-melting point polyester-type fibers having a relatively large fiber diameter and a long fiber length with natural pulp or organic synthetic fibers having a small density and then subjecting the mixture to a paper-fabrication process. Thus, a diaphragm having a high freeness is obtained by a relatively short fabrication process, whereby a bulky product is easily obtained. Furthermore, during the dry-heating step, hot air at a temperature higher than the melting point of the polyester-type fibers is used, so as to fuse only the intersections of the fibers without completely fusing the polyester-type fibers. The pressure of the hot air contributes to the formation of a predetermined shape. Since the method for producing the diaphragm according to the present invention performs no pressure-drying using a heated mold, which would be performed in the case of producing a diaphragm through a common paper-fabrication process, a diaphragm having a large thickness, a small density, a high internal loss, and a high stiffness can be obtained.

Thus, according to the present example, a diaphragm having a high elasticity modulus, a high internal loss, and a large thickness can be obtained. By employing this diaphragm, a loud speaker having small distortion and a broad reproducible frequency range can be obtained.

Moreover, the polyester-type fibers themselves have an extremely low moisture absorption, so that a diaphragm with a sufficient mechanical strength can be obtained even if a water-immersion process is conducted, which is conducted for mixing the polyester-type fibers with natural pulp or organic synthetic fibers and for the paper-fabrication of the mixture.

EXAMPLE 2

Figure 8:
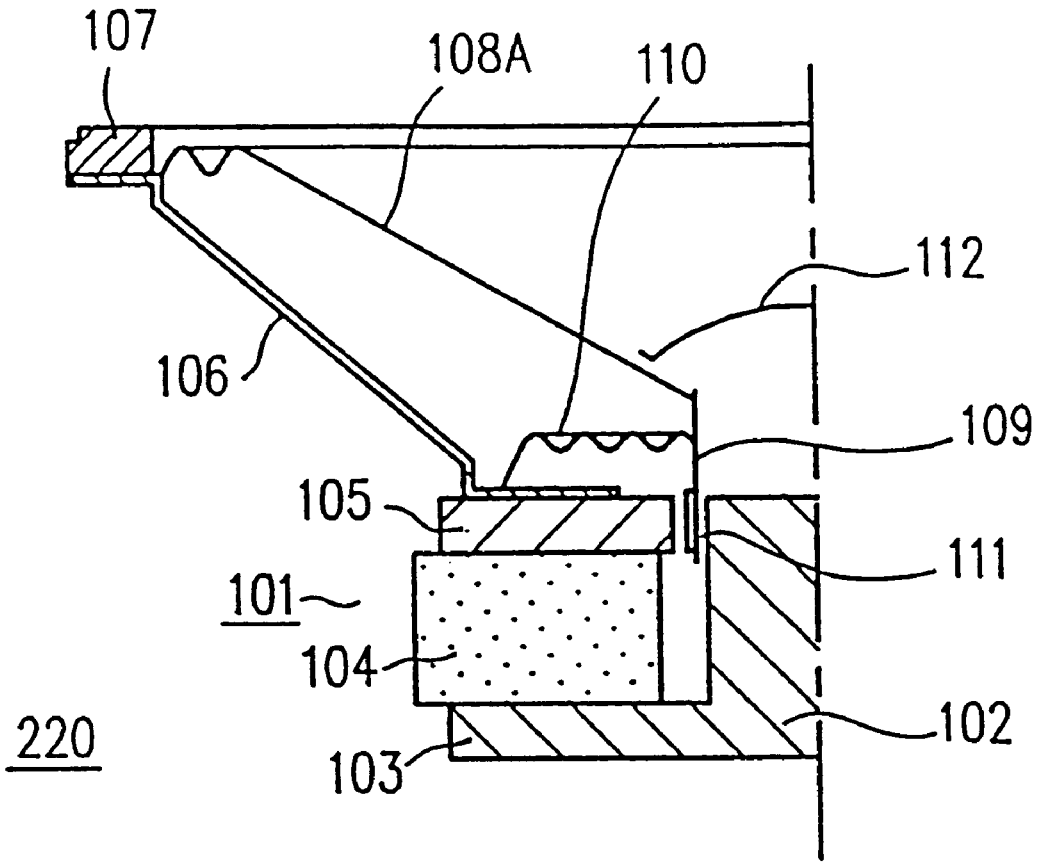
FIG. 8 is a half cross-sectional view showing a configuration for a loud speaker according to a second example of the present invention.
Figure 9:
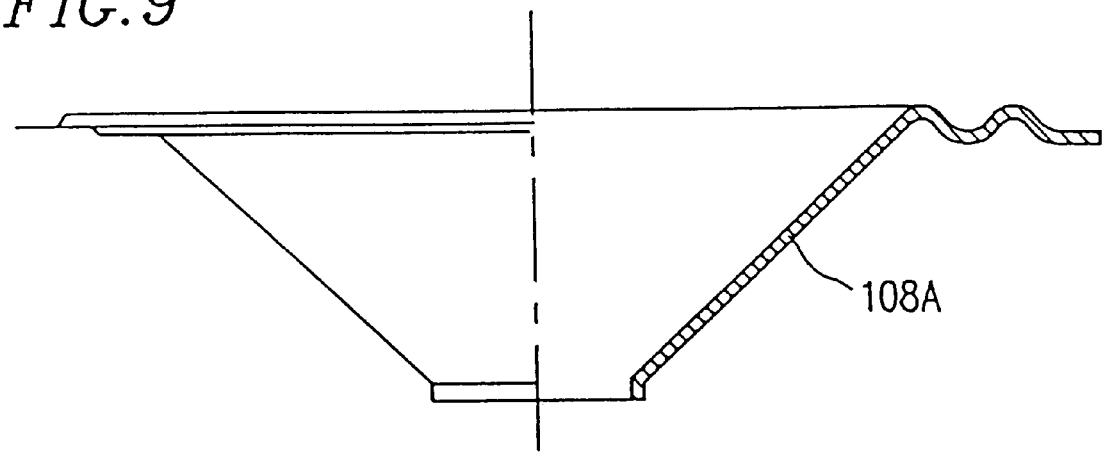
FIG. 9 is a half cross-sectional view showing a configuration for a diaphragm of the loud speaker shown in FIG. 8.

FIG. 8 is a half cross-sectional view showing a configuration for a loud speaker 220 according to a second example of the present invention. FIG. 9 is a half cross-sectional view showing a configuration for a diaphragm 108R incorporated in the loud speaker 220.

Since the configuration for the loud speaker 220 is basically the same as that of the loud speaker 120 of Example 1, which was described with reference to FIGS. 4 and 5, constituent elements in FIGS. 8 and 9 which also appear in FIGS. 4 and 5 are indicated by the same reference numerals. Consequently, the description thereof is omitted here.

Figure 10:
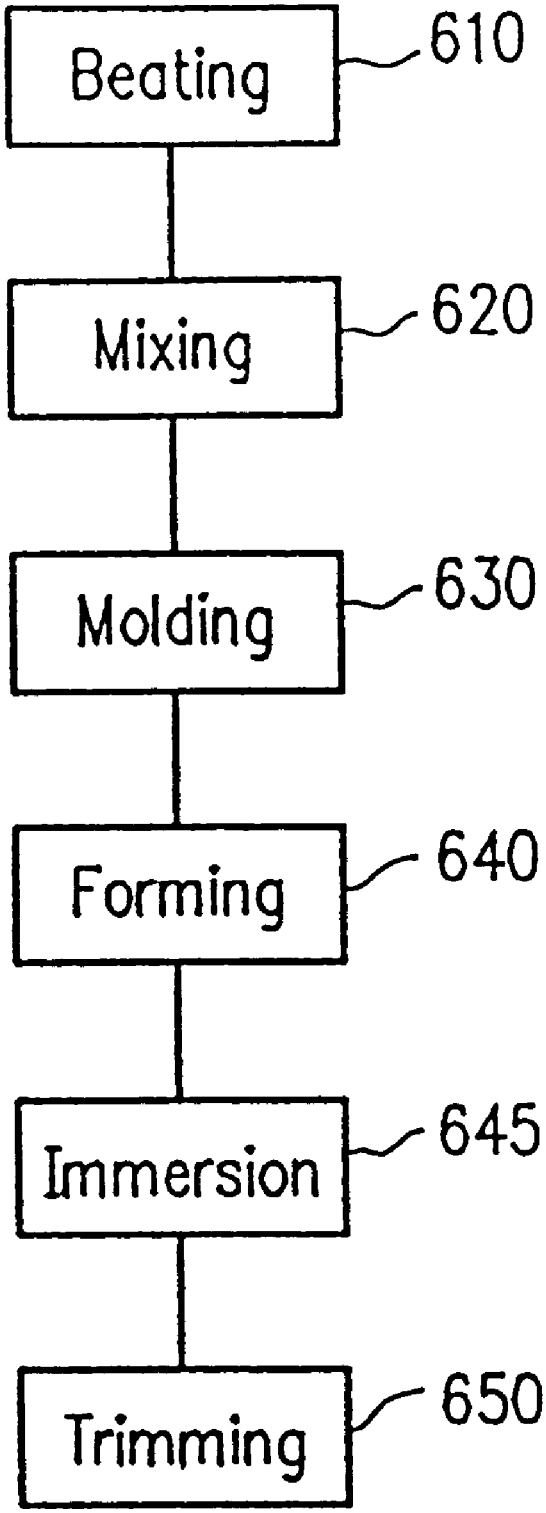
FIG. 10 is a flow chart showing the production process for the diaphragm shown in FIG. 9.

The loud speaker 220 differs from the loud speaker 120 with respect to the diaphragm 108A. Hereinafter, a method for producing the diaphragm 108A will be described with reference to a flow chart shown in FIG. 10.

First, in a beating step 610, UKP having a freeness (Canadian Freeness) of 550 cc is beaten so as to give a slurry of UKP. The UKP functions as a principal material Next, in a mixing step 620, predetermined additives such as a reinforcement material, a dye, and a binder are mixed with the UKP slurry thus obtained Specifically, in the present example, meta-type aramid resin pulp is first added in an amount of about 5% to about 20% by weight based on the absolute dry weight of the UKP. Typically, a product designated as "CONEX pulp" (manufactured by Teijin Ltd.) is added in an amount of 10% by weight based on the absolute dry weight of the UKP. Furthermore, a fluorine-type water repellent is added in an amount of about 2 to about 20 cc to an absolute dry weight of 100 g of the UKP. For example, 10 cc of "DICGUARD F-400" (manufactured by Dainippon Ink and Chemicals, Inc.) may be added to an absolute dry weight of 100 g of the UKP. After adding a dye to the resultant mixture and stirring the mixture, an aluminum sulfate is employed to adjust the pH of the slurry to be in the range of about 4.5 to about 5.0. Thus, the fluorine-type water repellent is affixed to the UKP.

Furthermore, in a molding step 630, that is, in a paper-fabrication step, the above-mentioned mixture (slurry) is subjected to a paper-fabrication process by using a screen formed into a desired shape of the diaphragm 108A, e.g., a conical shape, and is dehydrated.

Then, in a forming step 640, the fabricated product is subjected to a heat-pressure-drying process by setting the product in a mold having the shape of the diaphragm 108A and preheated at about 160° C. to about 220° C., e.g., 200° C. Thus, the diaphragm 108A is obtained as a molded product having a predetermined shape.

Next, in an immersion step 645, the molded product obtained in the forming step 640 is immersed in a preformulated immersion solution, so as to impregnate the product with the solution. Thereafter, the product impregnated with the solution is dried against wind at room temperature for about 10 minutes, and is further dried for about 10 minutes in an oven set at an appropriate temperature, e.g., 120° C. Thus, a water-repellent synthetic resin film is formed on the surface of the molded product.

The immersion solution is prepared by diluting 50 g of a saturated copolymer polyester resin solution, e.g., a product designated as "Polyester LP-011S50TO" (manufactured by Nippon Synthetic Chemical Industry, Co., Ltd.) with 200 cc of methyl ethyl ketone, adding 10 cc of a fluorine-type water repellent, e.g., a product designated as "SURFRON SR-137AR" (manufactured by SEIMI Chemical Co., Ltd.) to the resultant mixture, and then stirring the resultant mixture.

Finally, the molded diaphragm is subjected to a trimming process in a trimming step 650 so as to have predetermined inner and outer shapes. Thus, the diaphragm 108A having a predetermined shape, for example, a conical shape with a diameter of 160 mm is obtained.

In the above description, a meta-type aramid resin is mixed in a pulp material which includes natural pulp as a principal material and is water-proofed with a water-repellent. However, any other material which is water-proof synthetic pulp having a minute film-like shape may be mixed in the pulp material in the place of a meta-type aramid resin.

Although all the water-repellents used for the purposes of pulp affixation, immersion, and addition of a synthetic resin in the above description are fluorine type, it is also applicable to use water-repellents of other kinds.

Although a saturated modified polyester resin is used as the synthetic resin in the immersion step in the above description, any other material can be employed as long as the material sufficiently forms a film after being dried and does not degrade the paper diaphragm in terms of either the characteristics or the sound quality thereof. For example, an acryl-type resin may be employed.

Although a water-repellent synthetic resin film is formed on the surface of the molded product (diaphragm) by immersion-based impregnation in the above description, the immersion step may be replaced by any other method as long as the molded product (diaphragm) is appropriately impregnated with the synthetic resin so that a water-repellent synthetic resin film with an appropriate thickness is formed. In this respect, the above-mentioned immersion step 645 may be interpreted as an impregnation step.

EXAMPLE 3

A diaphragm according to a third example of the present invention is produced as follows. Since the configuration of the loud speaker of the present example is basically the same as those of the loud speakers 120 (Example 1; FIG. 4) and 220 (Example 2; FIG. 8), the description thereof is omitted. Since the same flow chart described in Example 2 (FIG. 10) applies to the production process of the loud speaker of the present example, the description thereof is also omitted.

First, in a beating step, UKP having a freeness (Canadian Freeness) of 550 cc is beaten so as to give a slurry of UKP. The UKP functions as a principal material.

Next, in a mixing step, predetermined additives such as a reinforcement material, a dye, and a binder are mixed with the UKP slurry thus obtained. Specifically, in the present example, modified polyester fibers (melting point: about 120° C. to about 180° C.; fiber length: about 1 to about 15 mm; thickness: about 0.5 to about 5 deniers) are first added in an amount of about 1% to about 50% by weight based on the absolute dry weight of the UKP. Typically, modified polyester fibers having a melting point of 130° C., a fiber length of 5 mm, and a thickness of 2 deniers are added in an amount of 10% by weight based on the absolute dry weight of the UKP. Furthermore, meta-type aramid resin pulp is added in an amount of 5% to 20% by weight based on the absolute dry weight of the UKP. Typically, "CONEX pulp"

(manufactured by Teijin Ltd.) is added in an amount of 10% by weight based on the absolute dry weight of the UKP. Furthermore, a fluorine-type water repellent is added in an amount of about 2 to about 20 cc to an absolute dry weight of 100 g of the UKP. For example, 10 cc of "DICGUARD F-400" (manufactured by Dainippon Ink and Chemicals, Inc.) may be added to an absolute dry weight of 100 g of the UKP. After adding a dye to the resultant mixture and stirring the mixture, an aluminium sulfate is employed to adjust the pH of the slurry to be in the range of about 4.5 to about 5.0. Thus, the fluorine-type water repellent is affixed to the UKP.

Thereafter, a molding step (a paper-fabrication step), a forming step, an immersion step, and a trimming step are conducted in the same manner as in Example 2, the descriptions thereof being omitted. Thus, a diaphragm, for example, having a conical shape with a diameter of 160 nm, is obtained.

In the above description, low-melting point polyester fibers and a meta-type aramid resin are mixed in a pulp material which includes natural pulp as a principal material and is water-proofed with a water-repellent. However, any other material which is waterproof synthetic pulp having a minute film-like shape may be mixed in the pulp material in the place of a meta-type aramid resin. It is also applicable to use, in the place of polyester fibers, any other material which has good comformability with pulp and appropriate water-proofness, e.g., aramid fibers. There is no limitation to the shape of the fibers to be mixed, either.

Although all the water-repellents used for the purposes of pulp affixation, immersion, and addition of a synthetic resin in the above description are fluorine type, it is also applicable to use water-repellents of other kinds.

Although a saturated modified polyester resin is used as the synthetic resin in the immersion step in the above description, any other material can be employed as long as the material sufficiently forms a film after being dried and does not degrade the paper diaphragm in terms of either the characteristics or the sound quality thereof. For example, an acryl-type resin may be employed.

The following examination was conducted in order to examine the water-proofness of the diaphragms of Examples 2 and 3. A cylindrical water tank was placed behind each of loud speakers incorporating diaphragms produced according to Examples 2 and 3. The loudspeaker corresponds to a bottom face of the tank. Tap water or an aqueous solution of a commercially available detergent for washing automobiles, e.g., a car shampoo, diluted so as to have a concentration of 5% was poured into each tank so as to be 30 mm deep. The infiltration of the respective solutions toward a front face of each loud speaker, i.e., a front face of each diaphragm, was observed.

In this water-proofness examination, neither the tap water or the car shampoo solution infiltrated through the diaphragms produced according to Examples 2 and 3 after a lapse of 96 hours, either to the surfaces or the side faces thereof.

For comparison, two conventional diaphragms A and B were subjected to the same water-proofness examination, the conventional loud speakers being produced as follows:

Conventional diaphragm A was produced by using a UKP slurry having a freeness of 550 cc, adding a fluorine-type water-repellent and a dye so as to be affixed thereto (in the same manner as in Example 2), subjecting the slurry to a paper-fabrication process by using a screen formed into the shape of a diaphragm, dehydrating the slurry, subjecting the slurry to a heat-pressure-drying process in a mold having the shape of the diaphragm and preheated at 200° C. Thus, the diaphragm was obtained as a molded product having a conical shape with a diameter of 16 cm. Conventional diaphragm B was produced by using a UKP slurry having a freeness of 550 cc, subjecting the slurry to a paper-fabrication process by using a screen formed into the shape of a diaphragm, dehydrating the slurry, subjecting the slurry to a heat-pressure-drying process in a mold having the shape of the diaphragm and preheated at 200° C. The molded material with a diaphragm shape thus obtained was subjected to an immersion process as in Example 2, whereby the diaphragm was obtained as a molded product having a conical shape with a diameter of 16 cm.

On conducting the same water-proofness examination for conventional diaphragms A and B thus obtained, it was observed that tap water infiltrated through conventional diaphragms A and B after a lapse of 24 to 48 hours, both to the surfaces or the side faces thereof. Car shampoo was recognized to have infiltrated to the surfaces or the side faces thereof after a lapse of 1 hour.

Moreover, the buckling strengths of the diaphragms produced according to Examples 1 and 2 and conventional diaphragms A and B were measured as follows. Each diaphragm was immersed in the above-mentioned car shampoo solution for 24 hours. Thereafter, each conical-shaped diaphragm was placed on a surface plate face down, the diaphragm being in a moistened state. A disk was placed on a neck portion of each diaphragm maintained in this state. Thus, a load was applied onto the disk in such a manner that the disk and the surface plate were kept parallel to each other. The load was gradually increased until reaching a value at which each diaphragm was destroyed, which value was defined as a buckling destruction strength. The same measurement was conducted for diaphragms, both conventional and according to the present invention, that were not immersed in car shampoo (hereinafter referred to as non-immersed diaphragms)

Table 1 shows the measured buckling destruction strength values. Each of the reduction rates shown in Table 1 represents a rate by which the buckling destruction strength of each diaphragm decreased after immersion, with respect to the buckling destruction strength of the non-immersed diaphragm.

TABLE 1

| | Buckling strength | | |
|---|---|---|---|
| | Before examination (kg) | After examination (kg) | Reduction rate (%) |
| Invention Example 2 | 3.44 | 1.22 | 64.5 |
| Invention Example 3 | 3.88 | 1.54 | 60.3 |
| Conventional Example A | 3.29 | 0.76 | 76.9 |
| Conventional Example B | 3.38 | 0.81 | 76.3 |

As shown in Table 1, the diaphragms produced according to Examples 2 and 3 of the present invention have smaller reduction rates of buckling destruction strength than the conventional diaphragms. Thus, the diaphragms according to the present invention have excellent water-proofness and maintain high buckling strength. As for Examples 2 and 3, in comparison, the reduction rate of the diaphragm of Example 3 is smaller than that of the diaphragm of Example 2, indicating the superior water-proofness and high buckling strength of the diaphragm of Example 3. These are the advantages which result from the low-melting point and strong polyester fibers mixed in the material being fuse-bonded at intersections thereof during the heat-pressure-drying molding step, the fibers thus constituting a three-dimensional net-like structure.

As described above, in accordance with the diaphragms produced according to Examples 2 and 3, a molded product is obtained by dry-molding a principal material of water-repellentized natural pulp, which is mixed with water-proof synthetic pulp having a minute film-like shape. Furthermore, the molded product is impregnated with a synthetic resin solution mixed with a water-repellent and is dried, so as to obtain a water-repellent synthetic resin film on the surface of the molded product. As a result, water is prevented from entering the diaphragm, so that the water absorption of the diaphragm is reduced without ruining the advantages of the paper diaphragm and without requiring specific jigs and equipment. In particular, the diaphragm has a sufficient resistance against surfactants. Moreover, since the water-proof synthetic pulp having a minute film-like shape adheres to the surface of the natural pulp fibers, such as wood pulp, so as to form a film thereon strongly entangled with the natural pulp, the diaphragm maintains a strong buckling strength even if water enters the inside of the diaphragm so as to moisten it. In addition, the diaphragm, although water-repellent and water-proofed, can be produced at a relatively low cost. By using the above-mentioned diaphragm, a high performance loud speaker having an excellent water-proofness can be obtained.

EXAMPLE 4

Figure 11:
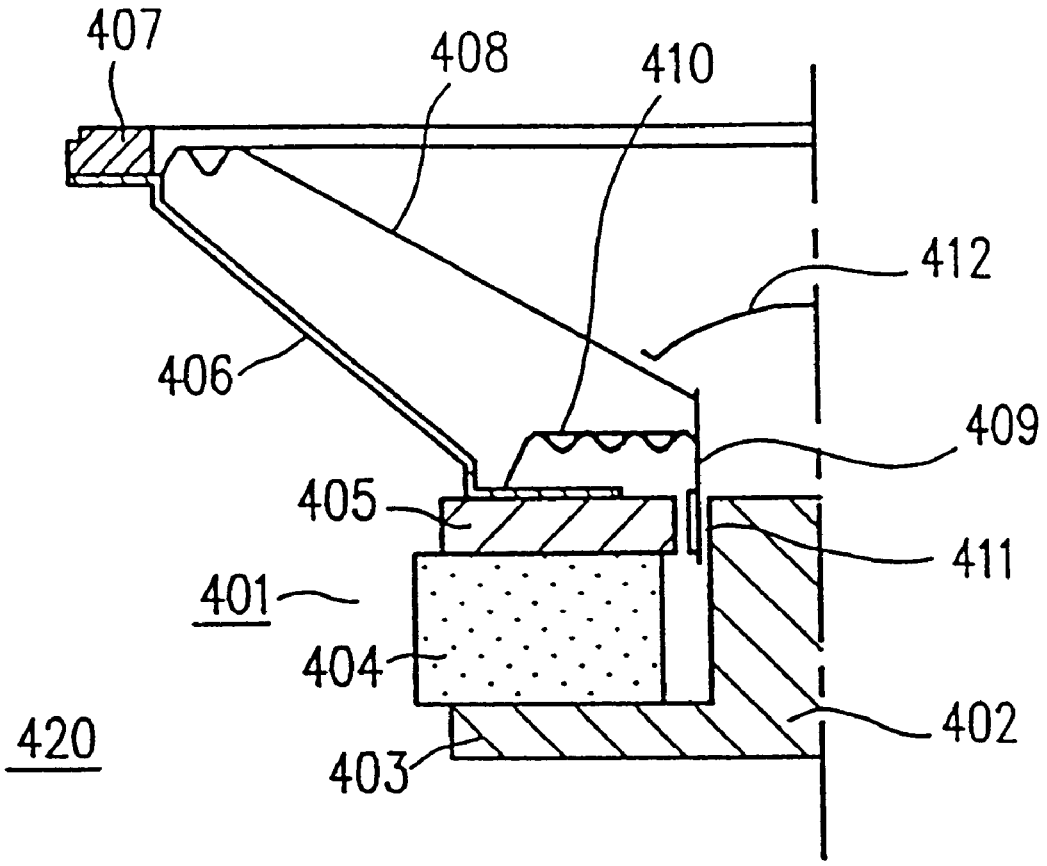
FIG. 11 is a half cross-sectional view showing a configuration for a loud speaker according to a fourth example of the present invention.
Figure 12:
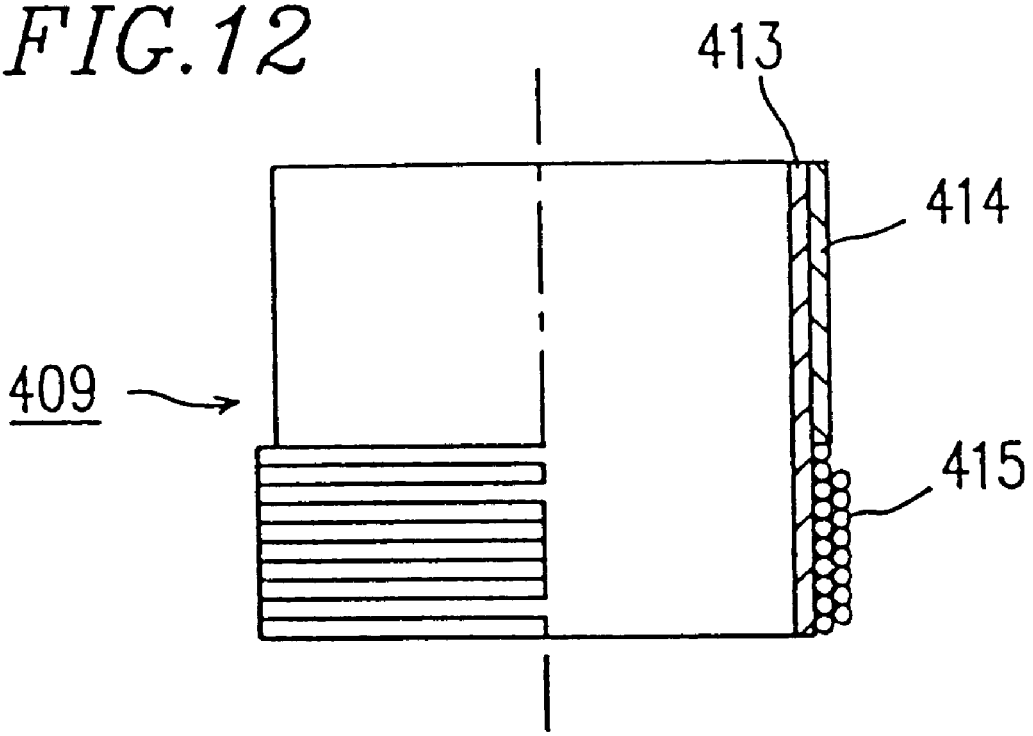
FIG. 12 is a half cross-sectional view showing a configuration for a voice coil in the loud speaker shown in FIG. 11.

FIG. 11 is a half cross-sectional view showing a configuration for a loud speaker 420 according to a fourth example of the present invention. FIG. 12 is a half cross-sectional view showing a configuration for a voice coil 409 incorporated in the loud speaker 420.

Since the configuration for the loud speaker 420 is basically the same as that of the loud speaker 120 of Example 1, which was described with reference to FIGS. 4 and 5, constituent elements in FIGS. 11 and 12 which also appear in FIGS. 4 and 5 are indicated by the same reference numerals. Consequently, the description thereof is omitted here.

The loud speaker 420 differs from the loud speaker 120 with respect to the voice coil 409. Hereinafter, a configuration for the voice coil 409 will be described with reference to FIG. 12.

A bobbin 413 included in the voice coil 409 is formed by using a sheet which includes water-proofed and heat-resistant synthetic pulp having a minute film-like shape as a principal material, the synthetic pulp exhibiting auto-fusion properties by pressure-heating. As the film-like synthetic pulp, pulp composed of a meta-type aromatic polyamide (aramid) may be used.

An inorganic filler, such as mica, is mixed in the film-like synthetic pulp in an amount of about 20% to about 50%, and preferably about 35% to about 50%, by weight. Furthermore, water-proof and heat-resistant synthetic fibers are mixed in the film-like synthetic pulp in an amount of about 5% to about 30%, and preferably about 15% to about 25%, by weight. As the synthetic fibers, short fibers composed of para-type aromatic polyamide may be used.

The film-like synthetic pulp, in which the inorganic filler and the synthetic fibers are mixed in the above-mentioned manner, is subjected to a paper-fabrication process and a heat-pressure process by means of a calender so as to form a sheet to be used as the bobbin 413. The thickness of the sheet after the calender process is typically about 30 to about 500 pm. The bulk density is typically about 0.6 to about 1.5 g/cm$^3$.

Since the pulp composed of meta-type aromatic polyamide (aramid) exhibits auto-fusion properties by pressure-heating, a flame-resistant sheet with excellent thermal stability can be obtained by the inclusion of the inorganic filler, such as mica, in an amount of about 35% to about 50% by weight.

By impregnating this sheet with about 15% to about 25% by weight of a thermosetting resin such as epoxy resin or phenol resin, the stiffness thereof can be improved. Thus, a light-weight bobbin 413 having excellent flame resistance, stiffness, and thermal stability can be obtained.

By the above impregnation process, it becomes easy to cut the sheet constituting the bobbin 413. As a result, cross sections resulting from cutting the sheet are prevented from having burrs, and the aromatic polyamide fibers are prevented from remaining without being completely severed. Thus, fibers are prevented from projecting from the surface of the sheet, which may cause extraordinary noises during the operation of a loud speaker.

If the impregnated amount of the thermosetting resin is less than about 15% by weight, the water-proofness and the stiffness of the sheet are deteriorated. If the impregnated amount of the thermosetting resin is more than about 30% by weight, the sheet becomes fragile.

It is preferable that the meta-type aromatic polyamide pulp exists in an amount of about 10% to about 80% by weight. If the meta-type aromatic polyamide pulp content is less than about 10% by weight, the sheet does not attain sufficient strength. If the meta-type aromatic polyamide pulp content is more than about 80% by weight, the specific elasticity of the sheet becomes insufficient.

It is preferable that the para-type aromatic polyamide short fibers exist in an amount of about 5% to about 30% by weight in the sheet.

Mica is most preferable as the inorganic filler to be mixed in the sheet. Since the sheet is subjected to a paper-fabrication process, in particular, it is preferable to use mica grains having diameters smaller than about 16 mesh and larger than about 200 mesh as the principal material. If the inorganic filler content is less than about 35% by weight, the heat-resistance and stiffness of the sheet become slightly insufficient. If the inorganic filler content is more than about 50% by weight, the sheet surface has too large bumps and dents, which results in fragility in terms of the physical characteristics of the material.

The paper to be used in the paper-fabrication process may be the usual round net type or long net type.

Moreover, by performing a heat-press process with a calender after the paper-fabrication process, the specific elasticity and the water-proofness of the resultant sheet can be further improved. By the calender process, the auto-fusion properties of the meta-type aromatic polyamide (aramid) pulp are exhibited, and the adhesion of the mica is improved. Moreover, since the water-proofness of the sheet is also improved so that moisture is prevented from being absorbed into the voice coil 409 (bobbin 413), the generation of gas and/or voids due to an increase in the temperature of the voice coil 409 is reduced, thereby further improving the heat-resistance of the voice coil 409.

The above-mentioned sheet has excellent water-proofness. Since the sheet has moderate bumps and dents on the surface thereof, it exhibits excellent adhesion. By cutting this sheet into strips and forming the strips into cylinders, the light-weight bobbin 413 having excellent flame resistance, stiffness, and thermal stability can be obtained. A coil portion 415 is formed by winding a heat-resistant magnet wire around the outer periphery of the bobbin 413. Reinforcement paper 414 is wound around the outer periphery of the bobbin 413 excluding the coil portion 415 for reinforcement and insulation. Thus, the voice coil 409 shown in FIG. 12 is obtained.

By forming the reinforcement paper 414 of the same material as that of the bobbin 413 instead of kraft paper, the above-mentioned advantages of light-weight, flame resistance, stiffness, and thermal stability of the voice coil 409 (bobbin 413) can be further improved.

The voice coil 409 thus produced has excellent heat-resistance and stiffness, and yet has a small weight. By incorporating the voice coil 409 into a loud speaker, the bobbin 413 is prevented from being burnt and the coil 415 is prevented from falling off the bobbing 413, thereby providing a loud speaker having a stably excellent performance.

Tables 2 and 3 shown below indicate typical measurement values of the physical characteristics, e.g., thermal shrinkage, of three sheets to be used for the bobbin according to the present invention and a conventional material for a bobbin composed only of aromatic polyamide fibers. The three sheets to be used for the bobbin according to the present invention are all obtained by using aromatic polyamide fibers, mica powder, and phenol resin in three different content ratios as shown in Tables 2 and 3. These data were measured by a common method and the detailed description of the measurement method itself is omitted here.

TABLE 2

(The following thermal shrinkage data are measured by leaving the sheet in atmospheres at the respective temperatures for 30 minutes.)

| | | Invention 1 | Invention 2 | Invention 3 | Conventional |
|---|---|---|---|---|---|
| Composition | aromatic polyamide fibers (wt %) | 70 | 60 | 50 | 100 |
| | mica powder (wt %) | 30 | 40 | 50 | — |
| | phenol resin* (wt %) | 20 | 20 | 20 | — |
| Thermal Shrinkage | 200° C. | 0.1% or less | 0.1% or less | 0.1% or less | 0.5% |
| | 250° C. | 0.2% | 0.1% or less | 0.1% or less | 1.0% |
| | 300° C. | 0.2% | 0.2% | 0.1% or less | 1.8% |
| | 350° C. | 0.5% | 0.4% | 0.2% | 5.0% |
| | 400° C. | 2.0% | 1.5% | 1.0% | — |

TABLE 3

| | | Invention 1 | Invention 2 | Invention 3 | Conventional |
|---|---|---|---|---|---|
| Composition | aromatic polyamide fibers(wt %) | 70 | 60 | 50 | 100 |
| | mica powder (wt %) | 30 | 40 | 50 | — |
| | phenol resin(wt %)* | 20 | 20 | 20 | — |
| Physical Characteristics | thickness (mm) | 0.134 | 0.132 | 0.130 | 0.131 |
| | density ($g/cm^3$) | 0.88 | 0.95 | 1.02 | 0.86 |
| | elastic modulus ($\times 10^{10}$ $dyn/cm^2$) | 8.50 | 8.90 | 9.15 | 6.50 |
| | specific elastic modulus ($\times 10^5$ cm/sec) | 3.31 | 3.14 | 2.97 | 2.96 |
| | internal loss ($\times 10^{-2}$) | 3.05 | 3.50 | 3.45 | 2.60 |

In Tables 2 and 3, the content of the phenol resin (*) is indicated as percent by weight when the entire sheet is defined as 100.

As seen from Table 2, the sheets according to the present invention have excellent heat resistance and good dimensional stability. Therefore, by using any of these sheets for a voice coil incorporated in a loud speaker for receiving a large input, the voice coil can achieve sufficient characteristics In addition, as seen from Table 3, the sheets of the present invention all have light weight and excellent stiffness, as well as good water-proofness.

It is also applicable to form a metal powder layer on the surface of the outer surface of the bobbin 413 of the voice coil 409 shown in FIGS. 11 and 12 by vapor-depositing metal powder composed of light-weight non-magnetic material, e.g., aluminum, on the surface and thereafter coating resin on the surface. Alternatively, a metal powder layer may be formed by coating resin mixed with the above-mentioned metal powder on the surface. By adopting such a configuration including a metal powder layer, the heat radiation properties of the voice coil can be further improved, thereby preventing the temperature increase more effectively As a result, a loud speaker incorporating the voice coil can have its resistance against large input signals improved by about 10% to about 15% as compared with the case where no such metal powder layer is included.

Thus, the voice coil for a loud speaker according to the present example is formed by using as a bobbin a sheet which is obtained by subjecting water-proof and heat-resistant synthetic pulp having a minute film-like shape and exhibiting auto-fusion properties by a pressure-heating or a calender process, e.g., aromatic polyamide pulp, mixed with inorganic fillers and water-proof heat-resistant synthetic fibers, to a paper-fabrication process and subjecting the synthetic pulp to a heat-press process by means of a calender. As a result, a light-weight, water-proof and heat-resistant voice coil is obtained which is capable of sufficiently withstanding a large input signal applied thereto. Furthermore, by using the thus fabricated voice coil having flame-resistance, the risk of ignition and possible combustion is reduced, thereby providing for safety. Moreover, the voice coil has improved water-proofness, so that it will exhibit stably high performance even when applied to uses such as loud speakers for the doors of automobiles, where water-proofness is a strong requirement.

The above-described loud speaker according to the present invention incorporates a diaphragm having high internal loss and large stiffness, and therefore is capable of sound reproduction with little distortion in a broad range of frequencies as well as having improved water-proofness. By incorporating the heat-resistant voice coil of the present invention, the loud speaker is made capable of withstanding a large input signal applied thereto. Thus, a high-performance loud speaker having excellent flame-resistance and water-proofness can be provided.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A loudspeaker comprising:

a magnetic circuit portion including a magnetic gap;

a frame coupled to an upper face of the magnetic circuit portion;

a diaphragm, an outer periphery thereof being attached to an outer periphery of the frame; and a voice coil coupled to an inner periphery of the diaphragm, the voice coil being inserted into the magnetic gap, wherein the diaphragm is formed of a sheet obtained by mixing waterproofed natural pulp or organic synthetic fibers as a principal material with polyester-type fibers having a low melting point as a subordinate material under a prescribed process condition such that only intersections among the polyester-type fibers of the subordinate material are melt-bonded without being completely fused at portions other than the intersections.

2. A loudspeaker according to claim 1, wherein the melting point of the polyester-type fibers is in the range from about 120 to about 180° C.

3. A loudspeaker according to claim 1, wherein a thickness of the polyester-type fibers is in the range of about 0.5 to about 5 deniers.

4. A loudspeaker according to claim 1, wherein a fiber length of the polyester-type fibers is in the range of about 1 to about 15 mm.

5. A loudspeaker according to claim 1, wherein the polyester-type fibers are mixed in an amount of about 1 to about 50% by weight based on the principal material.

6. A loudspeaker according to claim 1, wherein the sheet is a non-laminated sheet.

7. A loudspeaker comprising:

a magnetic circuit portion including a magnetic gap;

a frame coupled to an upper face of the magnetic circuit portion;

a diaphragm, an outer periphery thereof being attached to an outer periphery of the frame; and a voice coil coupled to an inner periphery of the diaphragm, the voice coil being inserted into the magnetic gap, wherein the voice coil further comprises:

a cylindrical bobbin formed of a sheet obtained by mixing water-proof heat-resistant synthetic pulp having a minute film shape with inorganic fillers and water-proof heat-resistant synthetic fibers, and then subjecting the sheet to a paper fabrication process and to a pressure-heating process using a calender; and a coil wound on an outer surface of at least a portion of the bobbin, and wherein a bulk density of the sheet after being processed by the calender is in the range from about 0.6 to about 1.5 g/cm$^3$.

8. A loudspeaker according to claim 7, wherein the synthetic pulp is formed of a meta-type aromatic polyamide.

9. A loudspeaker according to claim 7, wherein the synthetic fibers are short fibers formed of a para-type aromatic polyamide.

10. A loudspeaker according to claim 7, wherein a thickness of the sheet after being processed by the calender is in the range from about 30 to about 500 $\mu$m.

* * * * *